US007588417B2

(12) United States Patent
Maniglier

(10) Patent No.: US 7,588,417 B2
(45) Date of Patent: Sep. 15, 2009

(54) TURBOMOLECULAR PUMP HAVING MULTISTAGE STATOR SPACERS

(75) Inventor: Laurent Maniglier, Faverges (FR)

(73) Assignee: Alcatel, Paris (FR)

( * ) Notice: Subject to any disclaimer, the term of this patent is extended or adjusted under 35 U.S.C. 154(b) by 692 days.

(21) Appl. No.: 10/768,695

(22) Filed: Feb. 2, 2004

(65) Prior Publication Data

US 2004/0156715 A1 Aug. 12, 2004

(30) Foreign Application Priority Data

Feb. 3, 2003 (FR) ..... 03 01223

(51) Int. Cl.
*F04D 19/04* (2006.01)
*F04D 29/54* (2006.01)

(52) U.S. Cl. ..... 415/193; 415/199.5; 415/210.1

(58) Field of Classification Search ..... 415/90, 415/193, 199.5, 209.1, 209.2, 209.3, 209.4, 415/210.1

See application file for complete search history.

(56) References Cited

U.S. PATENT DOCUMENTS

| | | | | |
|---|---|---|---|---|
| 5,158,426 | A * | 10/1992 | Casaro et al. | 415/52.1 |
| 6,332,752 | B2 * | 12/2001 | Ikegami et al. | 415/90 |
| 6,412,173 | B1 | 7/2002 | Johnson et al. | |
| 6,827,550 | B2 * | 12/2004 | Okudera et al. | 415/72 |

FOREIGN PATENT DOCUMENTS

| | | |
|---|---|---|
| DE | 2218615 | 10/1973 |
| DE | 297 17 764 U1 | 1/1998 |
| EP | 0 442 556 A1 | 8/1991 |
| EP | 1 249 613 A1 | 10/2002 |

* cited by examiner

*Primary Examiner*—Edward Look
*Assistant Examiner*—Nathaniel Wiehe
(74) *Attorney, Agent, or Firm*—Sughrue Mion, PLLC

(57) ABSTRACT

According to the invention, the stator is made by radially assembling together at least two stator sectors (21, 22) about a rotor (18). Each stator sector (21, 22) comprises a peripheral shell sector (24, 25) provided with internal annular grooves (24*a*-24*j*) in which stator vane sectors (26*a*-26*j*) are engaged individually. This facilitates assembly and provision of sub-assemblies constituting the turbomolecular pump.

14 Claims, 5 Drawing Sheets

TURBOMOLECULAR PUMP HAVING MULTISTAGE STATOR SPACERS

The present invention relates to turbomolecular pumps adapted to pump gases and create a high vacuum in a vacuum enclosure.

Turbomolecular pumps generally have a multistage peripheral stator with vanes engaged between the blades of a multistage central rotor.

A multistage rotor of a turbomolecular pump comprises an axial series of rotor stages each constituted by a central ring from which the blades of the rotor extend in a substantially radial direction, which blades are regularly distributed around the periphery of the central ring. The assembly is mounted to rotate about an axis of rotation, and is it is driven by motor means.

The multistage stator is made up of an axial series of annular stators each forming a stator stage, each stator stage being formed by an annular rim from which inclined vanes extend in a substantially radial direction.

The inclines vanes of a stator stage are engaged between the inclined blades of two successive rotor stages.

It will thus be understood that the presence of interleaved vanes and blades prevents the rotor from moving axially relative to the stator, whether during assembly of the turbomolecular pump, or during disassembly thereof.

Consequently, turbomolecular pumps have means enabling stator elements to be assembled and disassembled radially relative to the rotor.

After making a multistage one-piece rotor, the stator is made by progressively assembly around the rotor elements or subassemblies that are to make up the stator.

A first known stator structure for a turbomolecular pump is shown in FIG. 1. About a one-piece rotor (not shown in the figure) there are fitted progressively a plurality of stator vane sectors, firstly to form annular stator stages, and secondly to form the plurality of annular stator stages that are offset axially in order to make the successive stages of the stator.

When considering a rotor having its axis of rotation oriented vertically, a first stator sector having vanes 1 is interposed between two successive bladed rotor stages by the radial movement represented by arrow 2, and a second stator sector 3 is engaged by being moved radially in the opposite direction along arrow 4 so as to engage both stator sectors 1 and 3 between the same two stages of rotor blades, thereby forming an annular stator stage.

Thereafter, an annular spacer 5 is engaged axially by being moved in the direction of arrow 6, with the spacer 5 coming to bear on the peripheries of the two stator sectors 1 and 3. The dimensions of the spacer 5 are suitable for holding apart two successive stator stages with the same spacing as the two corresponding successive rotor stages.

Thereafter the two following stator sectors 7 and 8 are put into place in similar manner, followed by an annular spacer 9, and then two stator sectors 10 and 11 and an annular spacer 12, and so on as a function of the number of stator stages.

It will be understood that such a stator is fiddly to assemble, and that it requires components to be provided of dimensions that are determined with sufficient precision to ensure that the accumulated dimensional tolerances, if any, of the components amount to less than the axial dimensional tolerance of the rotor, so as to avoid any contact between the rotor blades and the stator vanes while the pump is in operation. As a result, manufacturing cost is relatively high and it would be advantageous to be able to reduce it.

FIG. 2 shows a second prior art turbomolecular pump structure comprising different means for solving the problem of interleaving the stator vanes between the rotor blades.

In that prior art structure, there can be seen the rotor 13 mounted to rotate about its axis of rotation I-I as represented by arrow 14, and comprising a series of rotor stages each comprising inclined blades. There can thus be seen successive rotor stages identified by numerical references 13*a*, 13*b*, 13*c*, 13*d*, 13*e*, 13*f*, 13*g*, 13*h*, and 13*i*. The stator 15 is made up of by assembling together two half-stators 15*a* and 15*b*, each half-stator 15*a* or 15*b* being constituted by a half-shell 16*a* or 16*b* in the form of a half-cylinder, with stator vanes extending radially inwards therefrom such as the vanes 17*a* and 17*b*, these vanes being organized as a series of stator stages that are interleaved between the blades of the rotor stages 13*a*-13*i*.

The presence of two one-piece half-stators 15*a* and 15*b* makes it possible to provide pumps that are insertable, being designed to be housed directly in a casing or a predefined customer system.

In this structure, each one-piece half-stator 15*a* or 15*b* is machined from a block of metal so as to provide the vanes 17*a* or 17*b*. Because of the configuration and the radially-converging orientation of the vanes, projecting from the concave inside face of the peripheral half-shells 15*a* or 16*b*, it is not possible to machine vanes 17*a* or 17*b* of radial length that exceeds some maximum length that is determined by the ability to pass milling tools for working on the vanes.

As a result, that prior art turbomolecular pump structure puts a limit on the maximum throughput of the turbomolecular pump, with the throughput limit being determined by the radial length of the vanes.

In addition, the half-stators 15*a* and 15*b* are relatively complex and expensive to make by machining, so the advantage of that pump structure is limited.

The problem posed by the present invention is to devise a novel turbomolecular pump structure capable of being made at lower cost, while avoiding assembling too great a number of parts and avoiding making parts that are too complex, and also enabling insertable turbomolecular pumps to be made having throughput greater than that obtained by the structure of FIG. 2.

Another problem is also to avoid needing to make component parts of dimensions that are very precise, since that increases the cost of producing a turbomolecular pump.

In order to achieve these and other objects, the invention provides a turbomolecular pump having a multistage peripheral stator of vanes engaged between the blades of a multistage central rotor, in which:

- the stator comprises a plurality of stator vane sectors assembled about the rotor;
- the stator vane sectors are distributed in a plurality of axial rows of stator vane sectors;
- each axial row of stator vane sectors is secured to a peripheral shell sector, thereby forming a multistage sector for a stator;
- each stator vane sector constitutes an individual element;
- the stator vane sectors in the same axial row of stator vane sectors are fitted and secured to the concave inside face of the corresponding peripheral shell sector so as to build up the multistage sector for the stator; and
- the concave inside face of the peripheral shell sector includes retaining means for individually retaining the stator vane sectors in position.

In such a structure, the stator vane sectors constitute individual elements which are easily made by machining metal parts, and the ease of machining enables stators to be made having vanes of radial dimensions that are greater than those which can be achieved in a structure of the kind shown in FIG. 2.

Simultaneously, the number of parts to be assembled together during assembly of a turbomolecular pump is smaller than that required for the prior art structure of FIG. 1.

And simultaneously, the component parts of such a turbomolecular pump structure can be made with tolerances that are less strict than can the parts of the FIG. 1 structure since the peripheral shell sector together with the retaining means itself constitutes a multi-stage spacer which individually positions the vane sectors of the stator, so it is no longer necessary to stack a plurality of parts that are put into place one after another.

In an advantageous embodiment, each of the stator vane sectors comprises a single row of vanes, each constituting a single-stage sector for a stator.

Nevertheless, without going beyond the ambit of the invention, it is possible to imagine stator vane sectors comprising two or more rows of vanes, each constituting part of a multistage stator, providing that this is possible given the way the vanes are machined.

The stator vane sectors can thus comprise at least one annular row of vanes secured to a rim in the form of a sector of a ring.

In a first option, the rim may connect together the outside ends of the vanes, in which case it is the rim that then forms the peripheral edge of each stator vane sector and which is fixed to the concave inside face of the corresponding peripheral shell sector in order to form the multistage sector of the stator.

Nevertheless, it may be advantageous to provide for the rim to connect together the inside ends of the vanes. Such a structure achieves better effectiveness in vacuum performance, and assembly is made easy by the fact that the vanes are machined from the outside of the rim in the form of a sector of a ring, on vanes that are oriented to diverge radially. It is then the outside ends of the vanes which form the peripheral edge of the stator vane sector and that are fixed to the concave inside face of the corresponding peripheral shell sector in order to make up the multistage sector of the stator.

The means for retaining stator vane sectors of the stator on the concave inside face of the peripheral shell sector may be of various kinds. In an advantageous embodiment, the concave inside face of the peripheral shell sector includes a plurality of annular grooves, and each of the stator vane sectors include at least one peripheral edge which is forced radially into one of the annular grooves of the peripheral shell sector.

When the stator sectors have a rim interconnecting the inside ends of the vanes, the peripheral edges of the stator vane sectors are constituted by the outside ends of the vanes of said sectors of the stator which are forced radially into the corresponding annular grooves of the peripheral shell sector.

When the sectors of the stator have a rim interconnecting the outside ends of the vanes, the peripheral edges of the stator vane sectors are constituted by the rims themselves which are forced into the annular grooves of the peripheral shell sector.

Other objects, characteristics, and advantages of the present invention appear from the following description of particular embodiments, made with reference to the accompanying drawings, in which.

Figure 1:
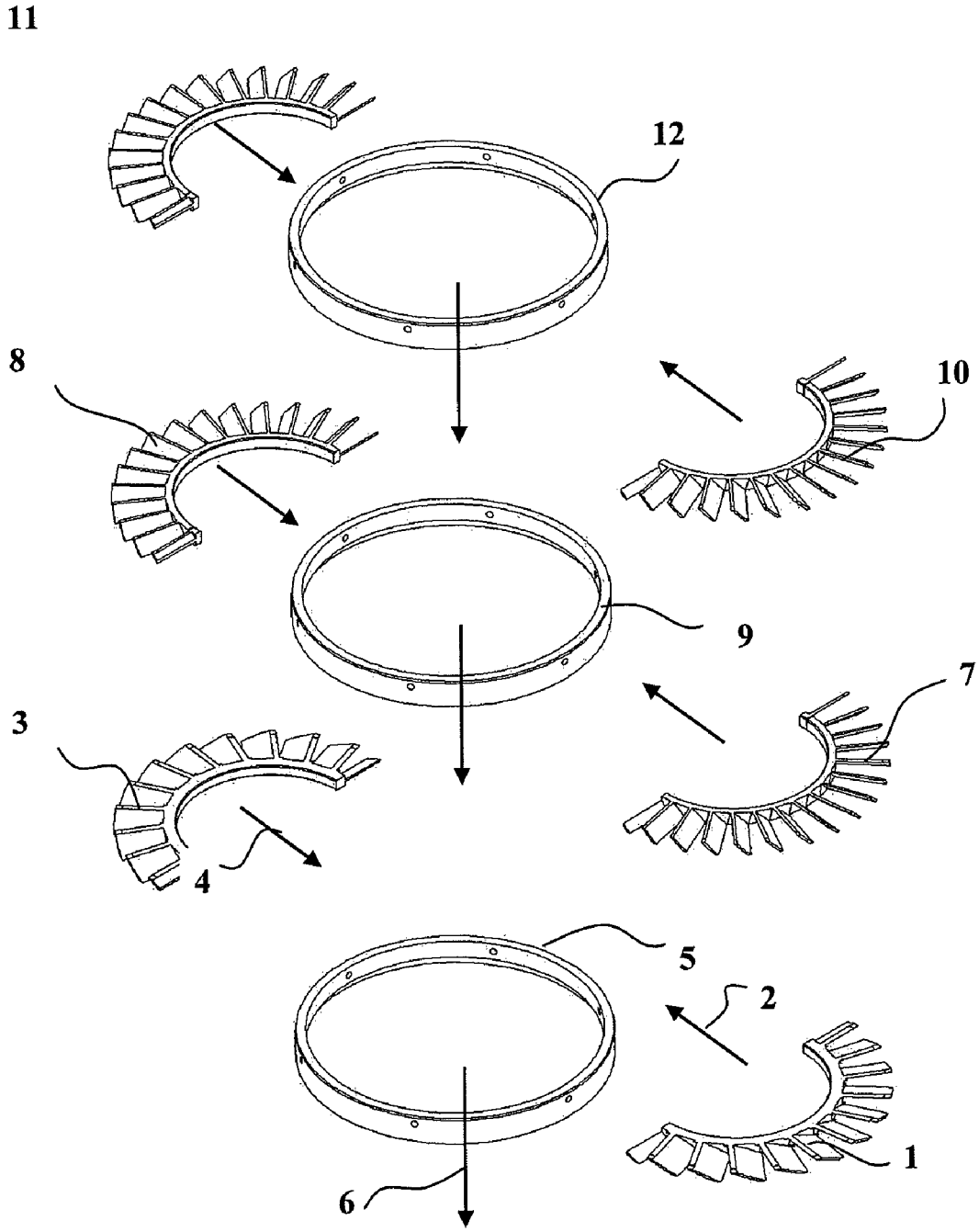
FIG. 1 (Prior Art)
FIG. 1 is an exploded perspective view showing a first prior art structure for a turbomolecular pump stator.
Figure 2:
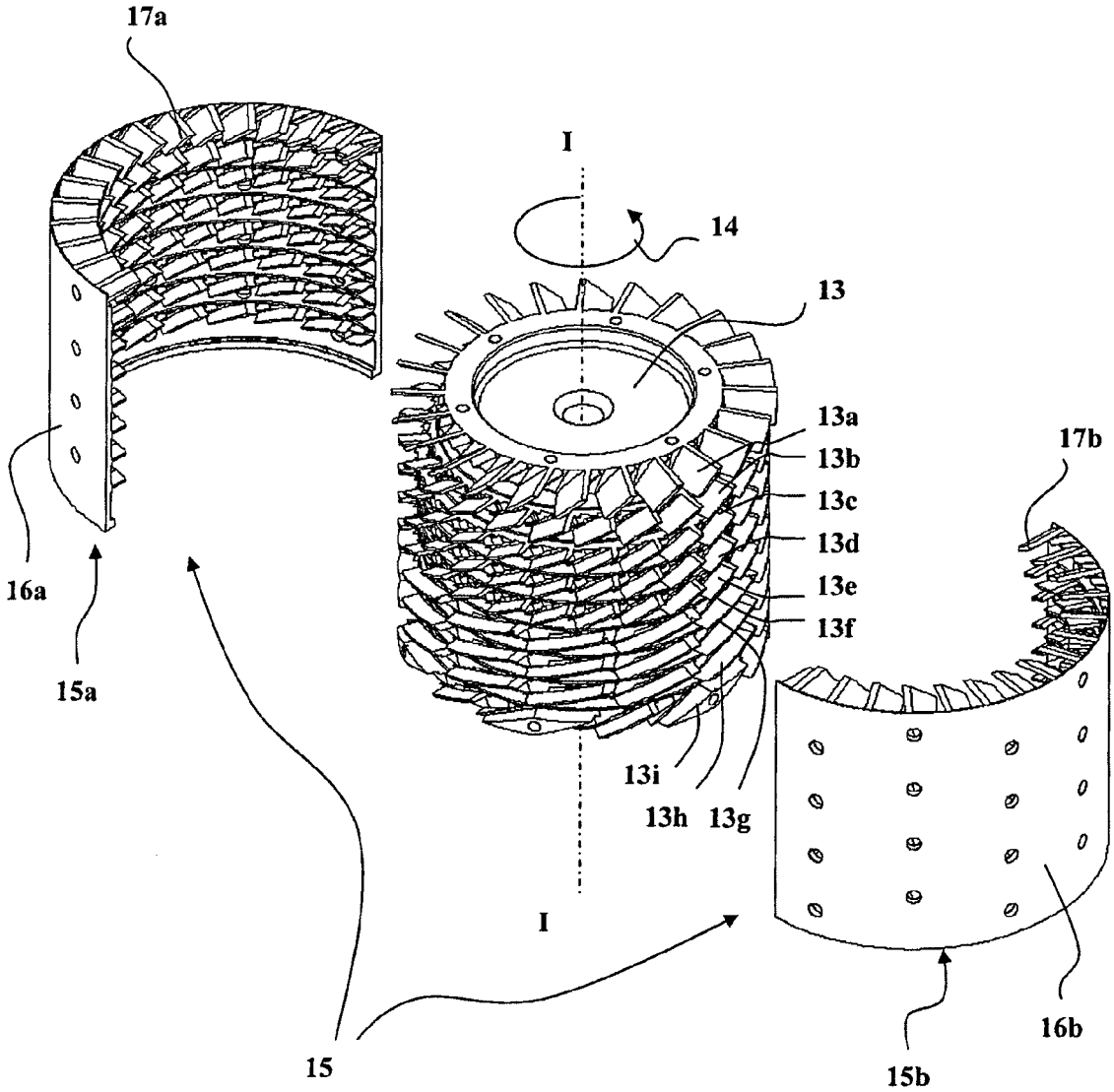
FIG. 2 (Prior Art)
FIG. 2 is an exploded perspective view showing a second prior art structure for a turbomolecular pump.

The structures of the prior art turbomolecular pumps of FIGS. 1 and 2 are described above.

Figure 3:
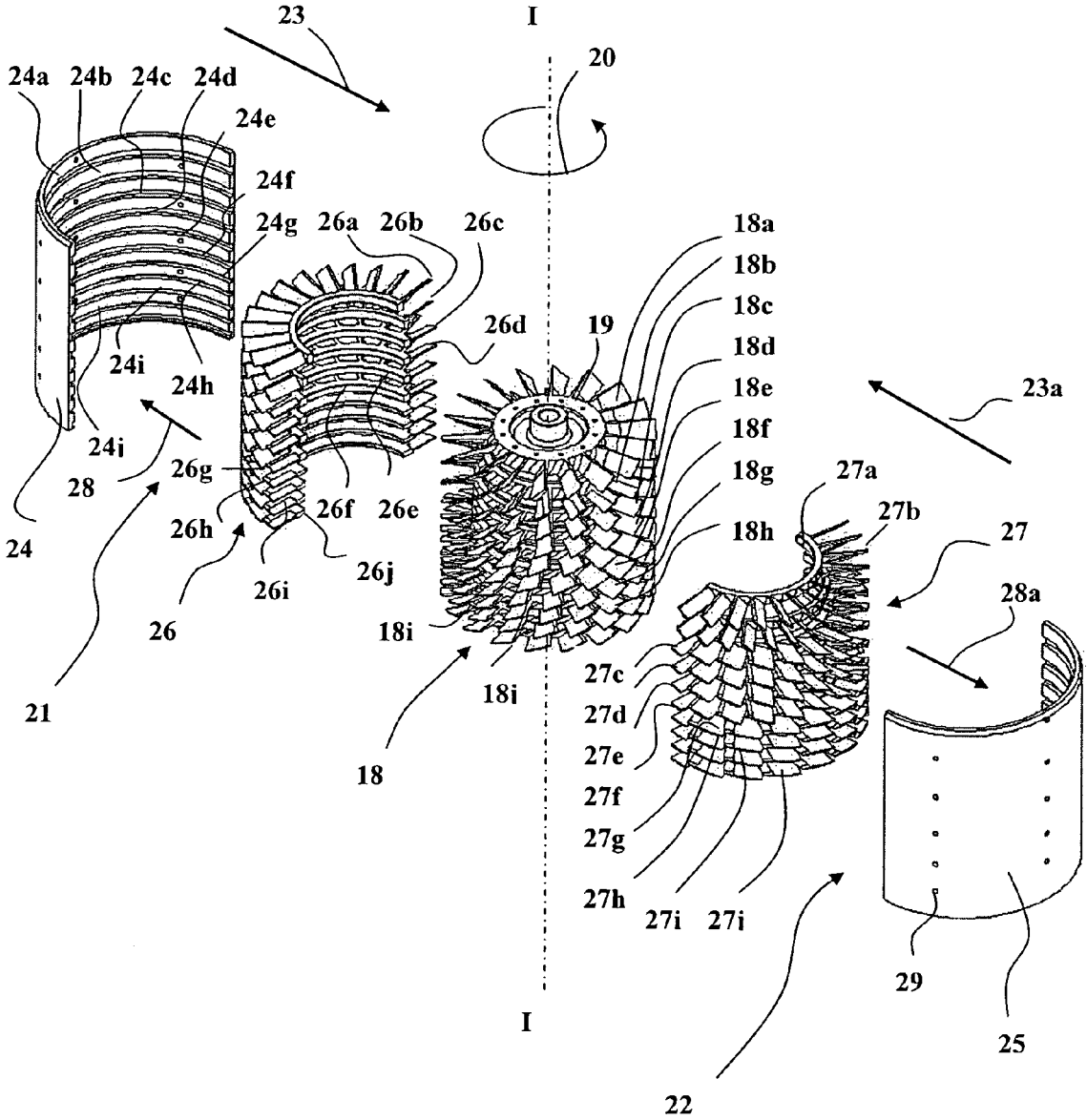
FIG. 3 is an exploded perspective view showing the general structure of a turbomolecular pump constituting an embodiment of the present invention.
Figure 4:
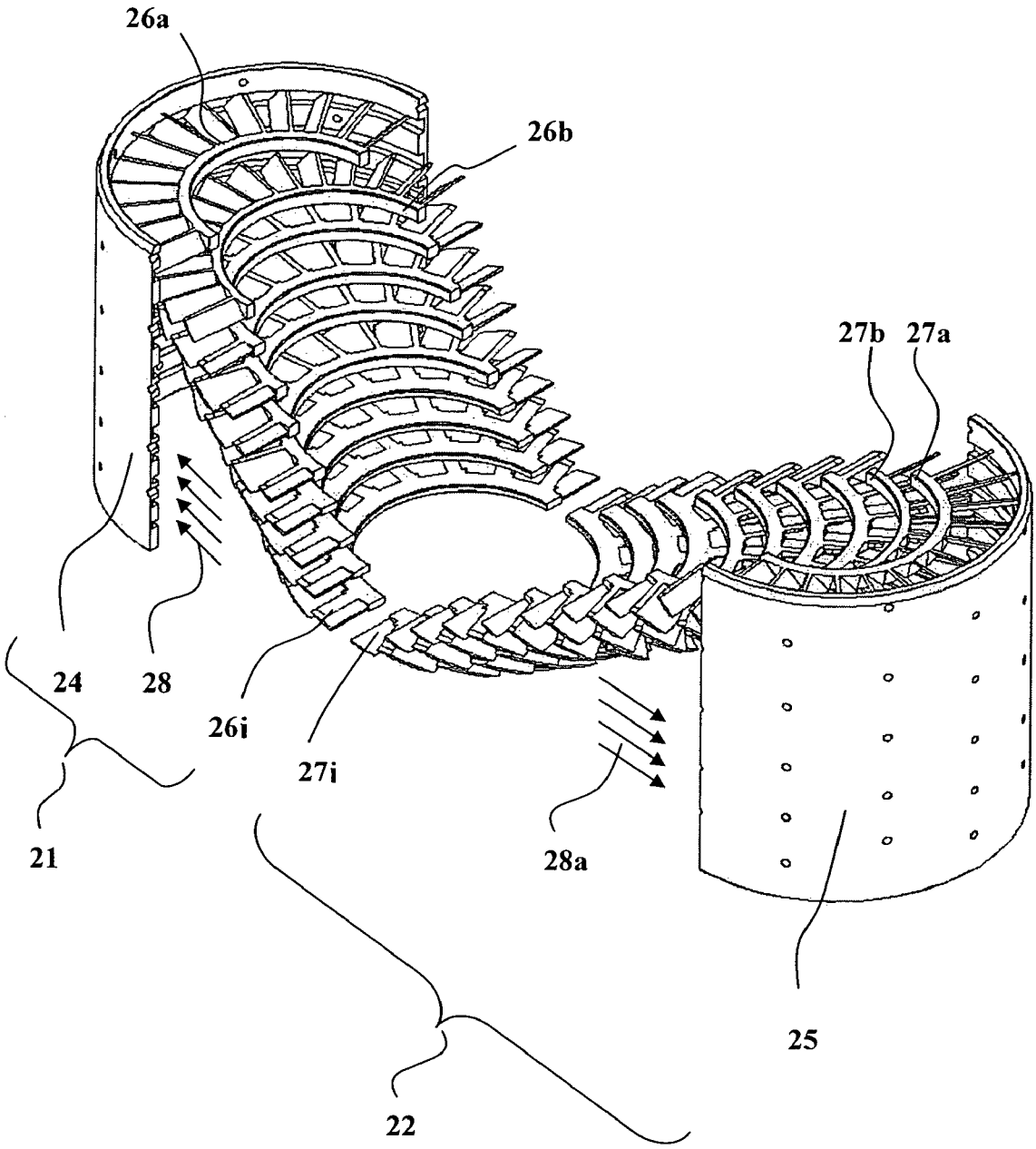
FIG. 4 is a perspective view showing how the stator vane sectors are assembled in succession to the corresponding peripheral shell sectors in accordance with the invention.

Reference is now made to FIGS. 3 and 4 showing a turbomolecular pump structure constituting an embodiment of the present invention.

In FIG. 3, the turbomolecular pump of the invention comprises a multistage rotor 18 comprising a series of rotor stages that are axially offset from one another and that are identified by numerical references 18*a*, 18*b*, 18*c*, 18*d*, 18*e*, 18*f*, 18*g*, 18*h*, 18*i*, and 18*j*. Each rotor stage 18 comprises an inner ring such as the ring 19 from which there project inclined blades such as the blade 18*a* oriented substantially radially outwards.

The rotor 18 is mounted to rotate about an axis of rotation I-I as represented by arrow 20.

The stator comprises an assembly of two subassemblies 21 and 22 each forming a multistage sector of a stator, with these sectors being put into place radially around the rotor 18 as represented by respective arrows 23 and 23*a*.

Each subassembly 21 and 22 comprises an assembly of a respective peripheral shell sector 24 or 25 with an axial row of stator vane sectors 26 or 27.

In the embodiment shown, there can thus be seen a first axial row of stator vane sectors 26 formed by the stator vane sectors 26*a*, 26*b*, 26*c*, 26*d*, 26*e*, 26*f*, 26*g*, 26*h*, 26*i*, and 26*j* aligned parallel with the axis of rotation I-I. Similarly, there can be seen a second axial row of stator vane sectors formed by the stator vane sectors 27*a*, 27*b*, 27*c*, 27*d*, 27*e*, 27*f*, 27*g*, 27*h*, 27*i*, and 27*j* aligned parallel with the axis of rotation I-I.

Figure 5:
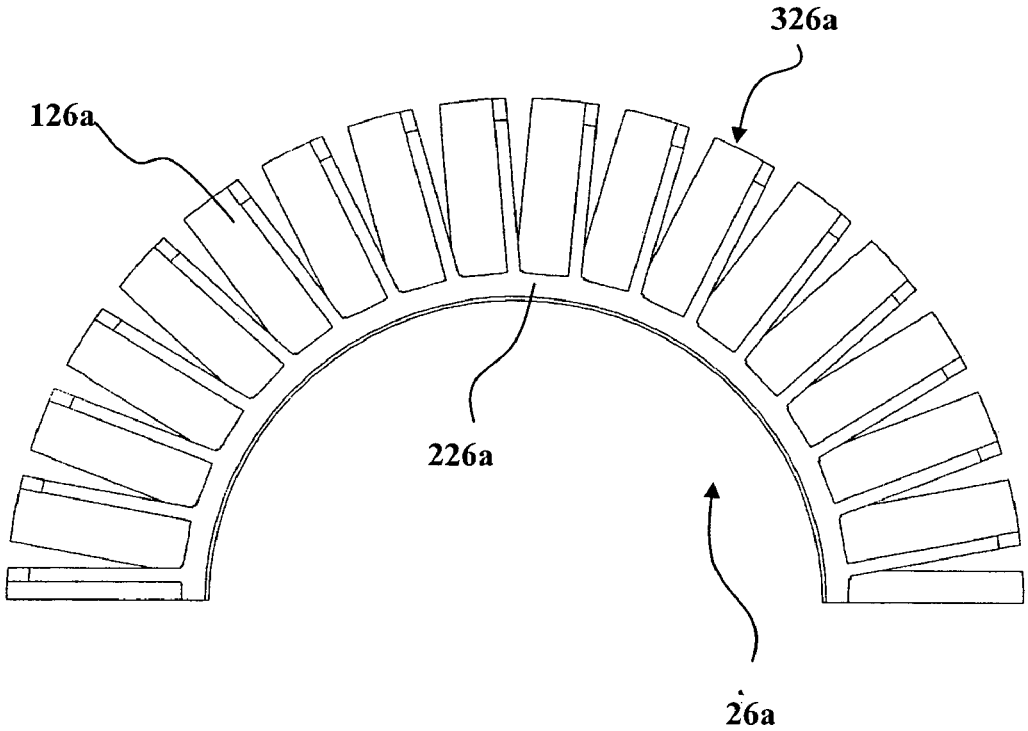
FIGS. 5 and 6 show two embodiments of stator vane sectors in accordance with the invention.

In the embodiment of FIG. 3, the stator vane sectors are of the type having an inside rim, as can be seen more clearly in FIG. 5. In this embodiment, the stator vane sector 26*a* comprises an annular row of sectors 126*a* secured to a rim 226*a*, itself in the form of a sector of a ring. The rim 226*a* connects together the inside ends of the vanes of the annular row 126*a* of vanes. The peripheral edge 326*a* of the stator vane sector 26*a* is thus constituted by the outside ends of the vanes in the annular row 126*a* of vanes.

Figure 6:
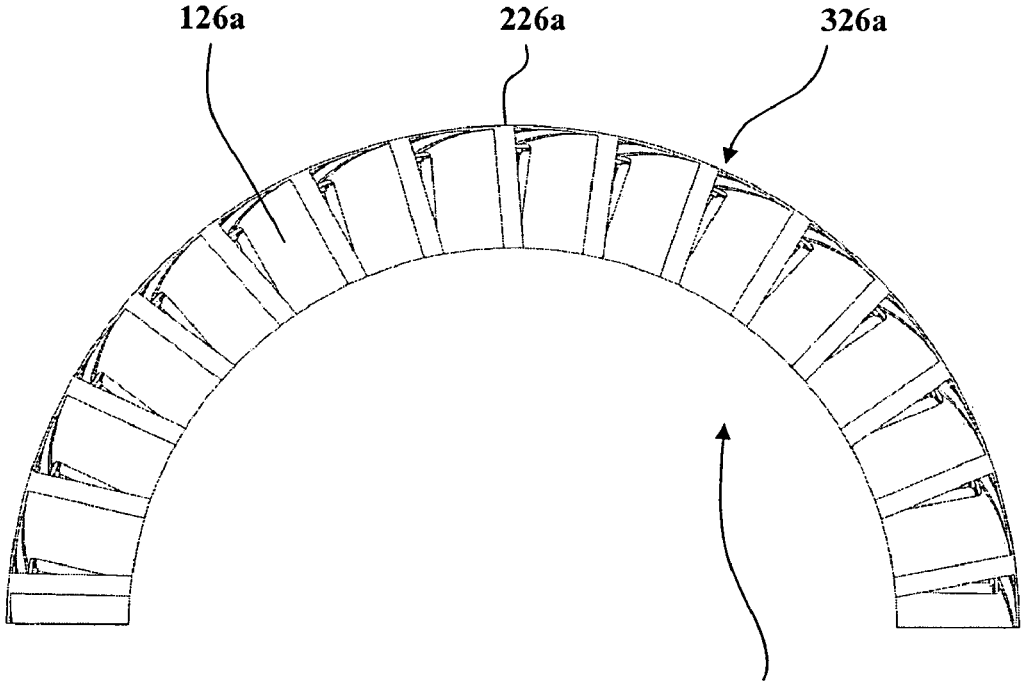

The invention can also be applied to a second embodiment of a stator vane sector as shown in FIG. 6. In this case, there can be seen a rim 226*a* and an annular row 126*a* of vanes. The rim 226*a* interconnects the outside ends of the vanes in the annular row 126*a* of vanes. The peripheral edge 326*a* of the stator vane sector 26*a* is then constituted by the rim 226*a* itself.

As can be seen with reference to the peripheral shell sector 24 of FIG. 3, the concave inside face of each peripheral shell sector 24 or 25 has a plurality of annular grooves. There can thus be seen annular grooves referenced 24*a*, 24*b*, 24*c*, 24*d*, 24*e*, 24*f*, 24*g*, 24*h*, 24*i*, and 24*j*.

Each annular groove 24*a*-24*j* is disposed and shaped so as to receive the peripheral edge of one of the stator sectors 26*a*-26*j*, thereby holding said stator sectors 26*a*-26*j* individually in position.

The same applies to the peripheral shell sector 25 which receives and retains the stator vane sectors 27*a*-27*j*.

During assembly, the stator vane sectors 26*a*-27*j* and 27*a*-27*j* are initially engaged radially so that their peripheral edges (such as the peripheral edge 326*a* of the stator vane sector 26*a*) penetrate into the corresponding annular grooves 24*a*-24*j* of the respective peripheral shell sectors 24 and 25, as represented, for example, by arrows 28 and 28*a*. Two multistage stator sectors 21 and 22 are thus made up which can subsequently be engaged radially around the rotor 18 as represented by arrows 23 and 23*a* in FIG. 3.

It will also be observed that, where necessary, the peripheral shell sectors such as the peripheral shell sector 25 may include holes such as the hole 29 in order to encourage the space situated at the periphery of the peripheral shell sectors 24 and 25 to be degassed.

In the embodiment shown in FIGS. 3 and 4, the stator is made by assembling together two multistage half-stators 21 and 22 each occupying a sector of 180°. In which case, the peripheral shell sector 24 or 25 is a half-cylinder and each stator vane sector 26*a*-26*j* and 27*a*-27*j* is a half-ring.

In the invention, and depending on the shapes of the vanes, it may be advantageous to provide a stator made by assembling together three multistage stator sectors each occupying 120°, or four multistage stator sectors each occupying 90°, or indeed multistage stator sectors occupying different angles.

Nevertheless, the structure shown minimizes the number of parts that need to be assembled together, and that can be advantageous.

Likewise, in the embodiment shown in FIGS. 3 and 4, the stator is a radial assembly of a single type of multistage stator sectors 21 and 22. In other words, in this case, each peripheral shell sector 24 or 25 covers the full length of the stator of the turbomolecular pump.

Alternatively, the stator may comprise an assembly of a plurality of multistage stator sectors. For example it is possible to make a first stator stage as shown in FIG. 3 connected axially to a second stator stage of similar structure, possibly with different vane structures and different diameters. The stator is then constituted by an assembly of a plurality of stages, each comprising multiple stages of stator sectors.

After making the turbomolecular pump assembly as shown in FIG. 3, the assembly needs to be inserted in a casing in order to make a functionally complete turbomolecular pump. A special casing can then be provided together with means for fixing it to an enclosure for evacuating.

Nevertheless, in accordance with the invention, it is possible to make a turbomolecular pump that is insertable, i.e. adapted to be inserted in a casing or a client system such as an enclosure for evacuating. The pump is then installed as close as possible to the application, thereby enabling pumping performance to be optimized. The shell sectors 24 and 25 enable the turbomolecular pump elements to be enclosed so as to constitute an assembly, possibly held together by temporary assembly means, which can themselves be removed when the pump is inserted into the client system.

In all cases, the shell sectors 24 and 25 should preferably be inserted with little clearance in the casing or the client system so as to ensure that good contact is established between the shell sectors 24 and 25 and the casing all the client system, thereby improving heat exchange.

The turbomolecular pump structure of the invention can be used with any possible vane shape in terms of inclination, inside diameter, outside diameter, stage height, and thickness.

The system also makes it possible to simplify stacking stages and stators and to be unaffected by the effect of putting the dimensional tolerances of a plurality of elements in series.

In addition, the structure improves heat exchange between the rotor and the surroundings via the shell sectors by encouraging thermal contact between the vanes of the stator and the shell sectors, then between the shell sectors and the casing or the peripheral pump housing, and by reducing the number of heat transmission discontinuities due to the one-piece nature of the multistage shell sectors.

This structure makes it possible to propose an insertable version for high throughput vacuum pumps.

The number of high precision parts is reduced compared with a conventional assembly. The cost of producing the pump is thereby greatly reduced.

The present invention is not limited to the embodiments described explicitly, but includes any variant and generalizations that come within the competence of the person skilled in the art.

What is claimed is:

1. A turbomolecular pump having a multistage peripheral stator of vanes engaged between the blades of a multistage central rotor (18), in which:

the stator comprises a plurality of stator vane sectors (26*a*-26*j*; 27*a*-27*j*) assembled about the rotor (18);

the stator vane sectors (26*a*-26*j*; 27*a*-27*j*) are distributed in a plurality of axial rows of stator vane sectors (26, 27); and each axial row of stator vane sectors (26, 27) is secured to a peripheral shell sector (24, 25), thereby forming a multistage sector for a stator;

wherein:

each stator vane sector (26*a*-26*j*; 27*a*-27*j*) comprises an individual element;

the stator vane sectors in the same axial row of stator vane sectors (26, 27) are fitted and secured to the concave inside face of the corresponding peripheral shell sector (24, 25) so as to build up the multistage sector for the stator;

the concave inside face of the peripheral shell sector (24, 25) includes retaining means (24*a*-24*j*) for individually retaining the stator vane sectors (26*a*-26*j*) in position; and wherein the peripheral shell sector covers a full axial length of the stator.

2. A turbomolecular pump according to claim 1, wherein each of the stator vane sectors (26*a*-26*j*, 27*a*-27*j*) comprises a single row of vanes, each comprising a single-stage sector for a stator.

3. A turbomolecular pump according to claim 1, wherein each stator vane sector (26*a*-26*j*; 27*a*-27*j*) comprises at least one annular row of vanes (126*a*) secured to a rim (226*a*).

4. A turbomolecular pump according to claim 3, wherein the rim (226*a*) interconnects the inside ends of the vanes of the annular row of vanes (126*a*).

5. A turbomolecular pump according to claim 3, wherein the rim (226*a*) interconnects the outside ends of the vanes of the annular row of vanes (126*a*).

6. A turbomolecular pump according to claim 1, wherein:

the concave inside face of the peripheral shell sector (24, 25) includes a plurality of annular grooves (24*a*-24*j*); and each of the stator vane sectors (26*a*-26*j*) comprises at least one peripheral edge (326*a*) disposed into one of the annular grooves (24*a*-24*j*) of the peripheral shell sector (24).

7. A turbomolecular pump according to claim 6, wherein the peripheral edges (326*a*) of the stator vane sectors (26*a*-26*j*) comprise the outside ends of the vanes of said stator sectors (26*a*-26*j*).

8. A turbomolecular pump according to claim 6, wherein the peripheral edges (326*a*) of the stator vane sectors (26*a*-26*j*) comprise rims (226*a*) which interconnect the outside ends of the vanes of said stator vane sectors (26*a*-26*j*).

9. A turbomolecular pump according to claim 1, wherein the stator is a radial assembly of a single stage of multistage sectors for a stator (21, 22).

10. A turbomolecular pump according to claim 9, wherein the multistage sectors of the stator (21, 22) occupy sectors of 180°.

11. A turbomolecular pump according to claim 1, wherein the stator is an assembly of a plurality of stages of multistage sectors for a stator.

12. A turbomolecular pump according to claim 1, wherein the retaining means are integral so as to be fixed relative to the peripheral shell sector.

13. A turbomolecular pump according to claim 1, wherein the concave inside face of the peripheral shell sector (24, 25) includes one-piece integral construction retaining means (24*a*-24*j*) for individually retaining the stator vane sectors (26*a*-26*j*) in position.

14. A turbomolecular pump having a multistage peripheral stator of vanes engaged between the blades of a multistage central rotor, in which:

the stator comprises a plurality of stator vane sectors assembled about the rotor;

the stator vane sectors are distributed in a plurality of axial rows of stator vane sectors; and each axial row of stator vane sectors is secured to a peripheral shell sector, thereby forming a multistage sector for a stator;

wherein:

the stator vane sectors in the same axial row of stator vane sectors are filed and secured to the concave inside face of the corresponding peripheral shell sector so as to build up the multistage sector for the stator;

the concave inside face of the peripheral shell sector supports the stator vane sectors in position;

each of the stator vane sectors comprises at least one vane, wherein the vanes of the stator vane sectors each have a radial outer edge that defines an outermost periphery of the stator vane sector; and wherein the peripheral shell sector covers a full axial length of the stator.

* * * * *

UNITED STATES PATENT AND TRADEMARK OFFICE

CERTIFICATE OF CORRECTION

PATENT NO. : 7,588,417 B2
APPLICATION NO. : 10/768695
DATED : September 15, 2009
INVENTOR(S) : Laurent Maniglier It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1363 days.

Signed and Sealed this

Twenty-first Day of September, 2010

David J. Kappos

David J. Kappos
*Director of the United States Patent and Trademark Office*